US008128175B2

(12) United States Patent
Groelsma et al.

(10) Patent No.: US 8,128,175 B2
(45) Date of Patent: Mar. 6, 2012

(54) SUSPENSION SEATING

(75) Inventors: John C. Groelsma, Jenison, MI (US); John F. Aldrich, Grandville, MI (US); Eileen M. LaMore, Grand Haven, MI (US); Timothy P. Coffield, Grand Rapids, MI (US)

(73) Assignee: Herman Miller, Inc., Zeeland, MI (US)

( * ) Notice: Subject to any disclaimer, the term of this patent is extended or adjusted under 35 U.S.C. 154(b) by 212 days.

(21) Appl. No.: 12/455,374

(22) Filed: Jun. 1, 2009

(65) Prior Publication Data

US 2009/0302662 A1 Dec. 10, 2009

Related U.S. Application Data

(60) Provisional application No. 61/101,423, filed on Sep. 30, 2008, provisional application No. 61/058,783, filed on Jun. 4, 2008.

(51) Int. Cl.
*A47C 7/22* (2006.01)

(52) U.S. Cl. ..... 297/452.63; 297/440.15

(58) Field of Classification Search ..... 297/452.63, 297/440.15

See application file for complete search history.

(56) References Cited

U.S. PATENT DOCUMENTS

| | | | | |
|---|---|---|---|---|
| 1,982,516 | A | 11/1934 | Holmested | |
| 2,156,664 | A * | 5/1939 | Litle, Jr. | 297/452.63 X |
| 2,233,592 | A | 3/1941 | Dunajeff | |
| 2,433,012 | A | 12/1947 | Zalicovitz | |
| 2,549,902 | A | 4/1951 | Hibbard et al. | |
| 2,897,879 | A | 8/1959 | Brown et al. | |
| 3,081,129 | A | 3/1963 | Ridder | |
| 3,126,554 | A | 3/1964 | Janapol | |
| 3,174,741 | A | 3/1965 | Wolff | |
| 3,198,578 | A | 8/1965 | Geoffrey et al. | |
| 3,233,885 | A | 2/1966 | Propst | |
| 3,242,512 | A | 3/1966 | Beckman | |
| 3,251,077 | A | 5/1966 | Beckman | |
| 3,255,470 | A | 6/1966 | Knittel et al. | |
| 3,258,259 | A | 6/1966 | Bohlin | |
| 3,261,037 | A | 7/1966 | Cermak et al. | |
| 3,262,137 | A | 7/1966 | Beckman et al. | |
| 3,262,138 | A | 7/1966 | Knittel | |
| 3,263,247 | A | 8/1966 | Knittel et al. | |

(Continued)

FOREIGN PATENT DOCUMENTS

DE 1429266 A1 10/1968

(Continued)

OTHER PUBLICATIONS

Frolic website pages, printed Feb. 28, 2002, 52 pages.

(Continued)

*Primary Examiner* — Anthony D Barfield

(74) *Attorney, Agent, or Firm* — Brinks Hofer Gilson & Lione

(57) ABSTRACT

A suspension seating structure having a body support assembly which includes a membrane formed from at least one strap spanning across an opening. Each strap is coupled to a frame member through a retaining structure. The retaining structure is coupled with or forms part of each frame member and provides a structurally secure body support assembly. A cushion material encapsulates the membrane, where the cushion material contains relief channels to permit the membrane to respond more freely in response to a load.

19 Claims, 14 Drawing Sheets

U.S. PATENT DOCUMENTS 3,276,048 A 10/1966 Beckman
3,280,410 A 10/1966 Propst et al.
3,340,548 A 9/1967 Janapol
3,389,935 A 6/1968 Getz et al.
3,393,012 A 7/1968 Chancellor, Jr.
3,398,012 A 8/1968 Parkes et al.
3,531,552 A 9/1970 Getz et al.
3,559,978 A 2/1971 Molt
3,591,876 A 7/1971 Swindlehurst
3,633,228 A 1/1972 Zysman
3,681,797 A 8/1972 Messner
3,747,178 A 7/1973 Harder, Jr.
3,767,261 A 10/1973 Rowland
3,774,967 A 11/1973 Rowland
3,790,150 A 2/1974 Lippert
3,806,576 A 4/1974 Richardson et al.
3,807,800 A 4/1974 Morrison et al.
3,843,477 A 10/1974 Rowland
3,889,302 A 6/1975 Ketterer et al.
3,940,811 A 3/1976 Tomikawa et al.
3,999,234 A 12/1976 Regan
4,033,567 A 7/1977 Lipfert
4,036,526 A 7/1977 Baechle et al.
4,190,914 A 3/1980 Diallo
4,265,484 A 5/1981 Stalter
4,283,864 A 8/1981 Lipfert
4,367,897 A 1/1983 Cousins
4,383,342 A 5/1983 Forster
4,399,574 A 8/1983 Shuman
4,415,147 A 11/1983 Biscoe et al.
4,509,510 A 4/1985 Hook
4,559,656 A 12/1985 Foster
4,582,361 A 4/1986 Kennel
4,603,907 A 8/1986 Witzke
4,605,582 A 8/1986 Sias et al.
4,607,887 A 8/1986 Vail
4,644,593 A 2/1987 O'Brien
4,673,605 A 6/1987 Sias et al.
4,686,724 A 8/1987 Bedford
4,702,522 A 10/1987 Vail et al.
4,713,854 A 12/1987 Graebe
4,723,816 A 2/1988 Selbert et al.
4,744,351 A 5/1988 Grundei et al.
4,809,374 A 3/1989 Saviez
4,826,249 A 5/1989 Bradbury
4,880,276 A 11/1989 Shovar
4,890,235 A 12/1989 Reger et al.
4,972,351 A 11/1990 Reger et al.
4,980,936 A 1/1991 Frickland et al.
5,025,519 A 6/1991 Spann et al.
5,105,488 A 4/1992 Hutchinson et al.
5,153,956 A 10/1992 Nold
5,163,196 A 11/1992 Graebe et al.
5,165,125 A 11/1992 Callaway
5,239,715 A 8/1993 Wagner
5,316,375 A 5/1994 Breen
5,328,245 A 7/1994 Marks et al.
5,426,799 A 6/1995 Ottiger et al.
5,452,488 A 9/1995 Reinhardt
5,459,896 A 10/1995 Raburn et al.
5,489,145 A 2/1996 Van Hekken
D368,399 S 4/1996 Buffon
5,502,855 A 4/1996 Graebe
5,533,220 A 7/1996 Sebag et al.
5,558,314 A 9/1996 Weinstein
5,558,398 A 9/1996 Santos
5,572,804 A 11/1996 Skaja et al.
5,588,165 A 12/1996 Fromme
5,615,869 A 4/1997 Phillips et al.
5,624,161 A 4/1997 Sorimachi et al.
5,628,079 A 5/1997 Kizemchuk et al.
5,632,473 A 5/1997 Dias Magalhaes Querioz
5,638,565 A 6/1997 Pekar
5,720,471 A 2/1998 Constantinescu et al.
5,747,140 A 5/1998 Heerklotz
5,785,303 A 7/1998 Kutschi
5,787,533 A 8/1998 Fromme
5,820,573 A 10/1998 Ramos
5,826,946 A 10/1998 Matthews et al.
5,975,641 A 11/1999 Delesie
5,976,451 A 11/1999 Skaja et al.
6,029,962 A 2/2000 Shorten et al.
6,052,852 A 4/2000 Huang
6,059,368 A 5/2000 Stumpf et al.
6,098,313 A 8/2000 Skaja
6,101,651 A 8/2000 Tang
6,113,082 A 9/2000 Fujino
6,134,729 A 10/2000 Quintile et al.
6,170,808 B1 1/2001 Kutschi
6,217,121 B1 4/2001 Mollet
6,343,391 B1 2/2002 Le Gette et al.
6,343,394 B1 2/2002 Gandolfi
6,353,953 B1 3/2002 Tanaka et al.
6,382,603 B1 5/2002 Monson et al.
6,406,009 B1 6/2002 Constantinescu et al.
6,425,153 B1 7/2002 Reswick
6,427,990 B1 8/2002 Hartmann
6,477,727 B1 11/2002 Fromme
6,540,950 B1 4/2003 Coffield et al.
6,546,578 B1 4/2003 Steinmeier
6,598,251 B2 7/2003 Habboub et al.
6,663,178 B2 12/2003 Fourrey et al.
D486,027 S 2/2004 Baxter et al.
6,715,839 B2 * 4/2004 Legal ..... 297/452.63 X
6,726,285 B2 4/2004 Caruso et al.
6,746,085 B1 6/2004 Nelson
6,901,617 B2 6/2005 Sprouse, II et al.
6,932,432 B2 8/2005 Kawasaki
6,983,997 B2 1/2006 Wilkerson et al.
6,986,182 B2 1/2006 Mossbeck
7,108,330 B2 9/2006 Mizelle et al.
7,356,859 B2 4/2008 McCraw
7,441,758 B2 10/2008 Coffield et al.
2002/0106479 A1 8/2002 Coffield et al.
2004/0245839 A1 12/2004 Bodnar et al.
2004/0245840 A1 12/2004 Tuberben et al.
2004/0245841 A1 12/2004 Peterson et al.
2005/0116526 A1 6/2005 VanDeRiet et al.
2006/0267258 A1 11/2006 Coffield et al.
2006/0286359 A1 12/2006 Coffield et al.
2007/0246873 A1 10/2007 Brill et al.
2007/0262634 A1 11/2007 Brill et al.
2008/0217977 A1 9/2008 Aldrich et al.
2010/0127551 A1 5/2010 Heidmann et al.

FOREIGN PATENT DOCUMENTS

DE 297 12 721 U1 10/1998
EP 0086578 A2 8/1983
EP 0228350 A2 7/1987
EP 1034726 A1 9/2000
EP 1046361 A1 10/2000
EP 1057433 A1 12/2000
EP 1099397 A1 5/2001
EP 0996349 B1 11/2001
EP 0895739 B1 9/2002
GB 495814 A 11/1938
GB 1034630 A 6/1966
GB 1215028 A 12/1970
GB 1360375 A 7/1974
GB 2 088 206 A 6/1982
JP 2000-051010 2/2000
WO WO 99/22160 5/1999
WO WO 01/15572 A1 3/2001
WO WO 2005/041719 A2 5/2005

OTHER PUBLICATIONS

Lattoflex Bettsystem, Winx 100, Jan. 2001, 16 pages.

Lattoflex Bettsystem, Winx 200, Jan. 2001, 20 pages.

Lattoflex Bettsystem, Winx 300, Jan. 2000, 20 pages.

Nebel, Antonio et al., The Miracles of Science, Presentation Slides, Sep. 2003, 44 pages.

U.S. Appl. No. 61/000,348, for Brill et al., entitled "Body Support Structure," filed Oct. 25, 2007.

U.S. Appl. No. 61/175,670 for Brill et al., entitled "Multi-Layer Support Structure," filed May 5, 2009.
International Search Report for International Application No. PCT/US2009/045822, dated Jul. 13, 2009, 3 pages.
International Preliminary Report on Patentability for International Application No. PCT/US2009/045822, dated Dec. 6, 2010, 6 pages.

* cited by examiner

SUSPENSION SEATING

This application claims the benefit of U.S. Provisional Application No. 61/101,423, filed Sep. 30, 2008 and U.S. Provisional Application No. 61/058,783, filed Jun. 4, 2008, the entire disclosures of which are hereby incorporated herein by reference.

FIELD OF THE INVENTION

The present invention relates to body support assemblies, and more particularly, to a load bearing assembly creating a body support assembly over an opening defined by a support structure, such as the seat or back of a chair or bench, or a support surface of a bed, cot or other similar structure.

BACKGROUND

There are continuing efforts to develop new and improved load bearing assemblies. One of the objectives of these assemblies is to create a durable and inexpensive body support assembly that is relatively easy to manufacture and that can be easily attached to a support structure. For example, the load bearing assemblies can be configured with a suspension member, such as a membrane, or series of straps, which support the body of the user.

Load bearing support surfaces that currently exist generally have a linear force/deflection profile, which gives the body support assembly the feel of a drum or trampoline. In seating or other support-based applications, this may result in an uncomfortable and sometimes ergonomically unacceptable body support assembly. In some applications, the body support assembly is encapsulated by a foam or embedded in another structure to compensate for these deficiencies. However, the ability to tune the physical characteristics of a conventional molded seat is relatively limited and difficult to predict. Different materials and different material thicknesses can be used to add a limited degree of control over the characteristics of the seat, but this nominal level of control may not be adequate in many applications.

Conventional attachment mechanisms such as screws, adhesives, or the like may be utilized to attach the suspension members to the support structure. However, such mechanisms may be problematic because of the extra costs and time associated with additional materials and manufacturing steps. Accordingly, there continues to be a desire for providing a secure attachment mechanism for attaching the suspension member, or other support surfaces, to the support structure.

BRIEF SUMMARY

In one embodiment a body support assembly includes a pair of spaced a pair of spaced apart frame members defining an opening therebetween, where at least one of the frame members comprises a plurality of loops spaced along the frame, where each of the loops defines an aperture and an elastomeric member extending across the opening between the pair of spaced apart members, where the elastomer member comprises a retention portion disposed through the aperture.

In another embodiment the load bearing structure includes a pair of spaced apart frame members defining an opening therebetween where the pair of frame members comprises a plurality of continuous loops spaced along each frame member, where each of the loops defines an aperture and an elastomeric member extending across the opening between the pair of spaced apart frame members, where the elastomeric member comprises a first end having a first retention portion forming part thereof, the first retention portion being disposed through one of the plurality of loops on one of the pair of spaced apart frame members, and a second end having a second retention portion forming part thereof, the second retention portion being disposed through one of the plurality of loops on the other of the pair of spaced apart frame members.

A method of manufacturing a body support assembly includes providing a pair of spaced apart frame members, which defines an opening, at least one loop, and an elastomeric member, attaching the elastomeric member to one of the spaced apart frame members by inserting a retention portion of the elastomeric member through the at least one loop, stretching the elastomeric member across the opening, and attaching the elastomeric member to the other of the spaced apart frame members.

In another embodiment, a method of use of a body support assembly includes providing an elastomeric member stretched across a pair of spaced apart frame members, where the elastomeric members have a retention portion coupled to one of a plurality of loops spaced along the frame, applying a load to the elastomeric member, stretching the elastomeric member, and rotating the retention portion with respect to the frame members without decoupling the retention portion from the loop.

In yet another embodiment, a body support assembly comprises a pair of spaced apart frame members defining an opening therebetween, an elastomeric member extending across the opening between the pair of spaced apart members, where the elastomeric member is connected to the frame members, a cushion material configured to at least partially encapsulate the elastomeric member, and a relief channel formed within the cushion material.

In yet another embodiment, a method of manufacturing a body support comprises providing a pair of spaced apart frame members which define an opening and an elastomeric member, encapsulating the elastomeric member with a cushion material, forming at least one relief channel within the cushion material, and securing the elastomeric member across the opening between the pair of spaced apart frame members.

The foregoing paragraphs have been provided by way of introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
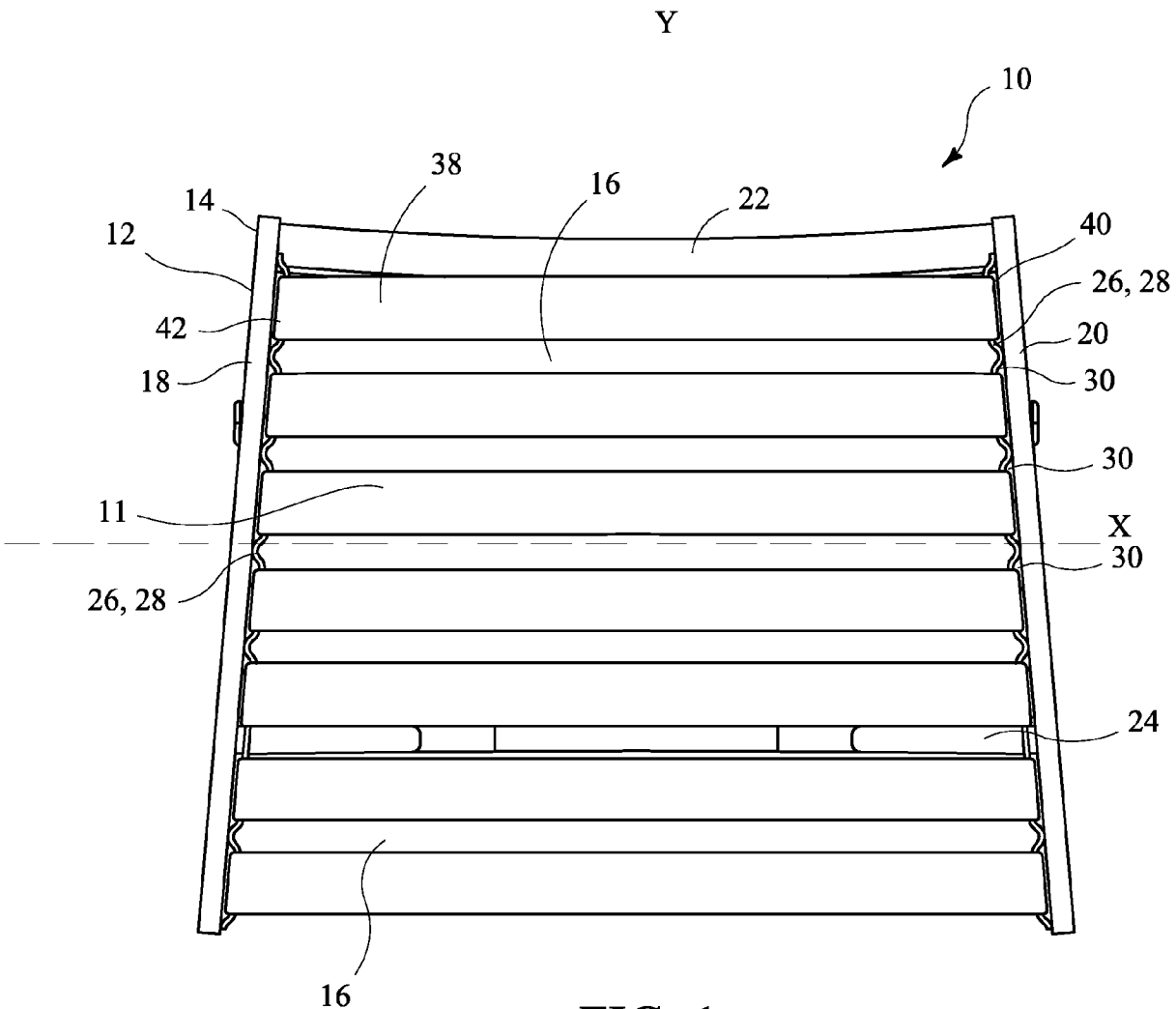
FIG. 1 is a perspective view of one embodiment of the body support assembly.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

A body support assembly 10 according to one embodiment of the present invention is illustrated in FIG. 1. For ease of referencing the orientations of components, the body support assembly 10 is said to extend in both the X and Y directions, as shown in FIG. 1. The body support assembly 10 generally includes a membrane 11 and a support structure 12. The support structure 12, as shown in this embodiment, is a frame having spaced apart frame members 14 which generally define an opening 16. The body support assembly 10 can form part of a back or seat, e.g. of a chair 13, a bed, or any other body support assembly.

Figure 5:
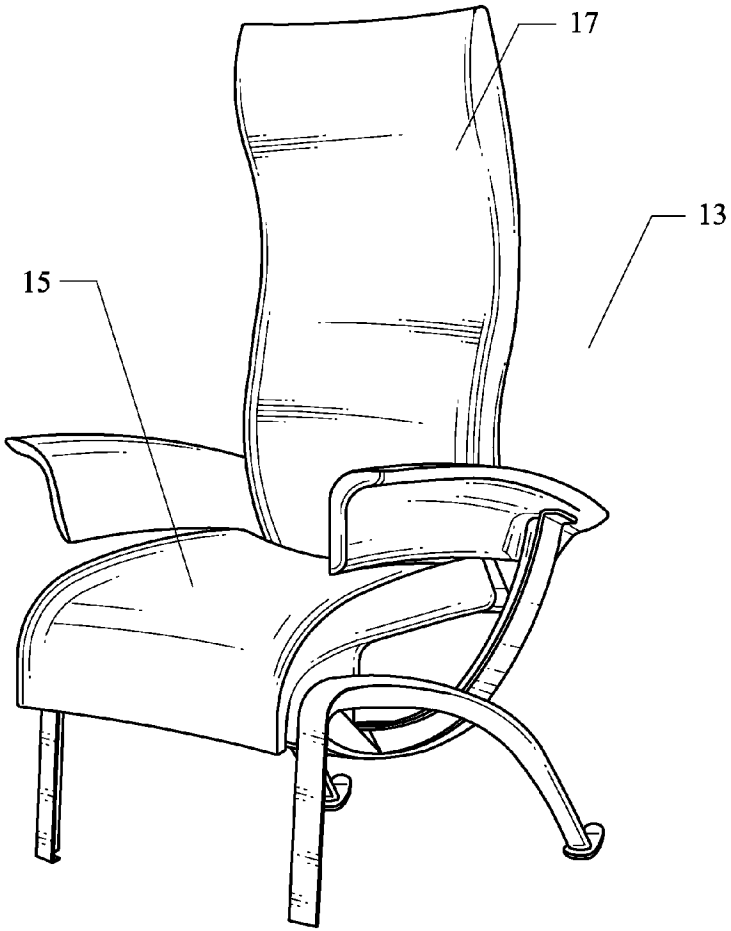
FIG. 5 is a perspective view of one embodiment of the body support assembly incorporated into a chair.
Figure 15:
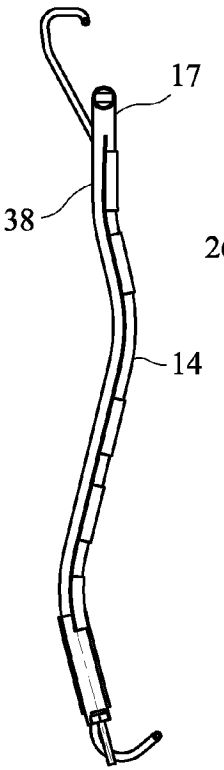
FIG. 15 is a side cross-sectional view of the body support assembly incorporated into a back portion of a chair shown in FIG. 11.
Figure 11:
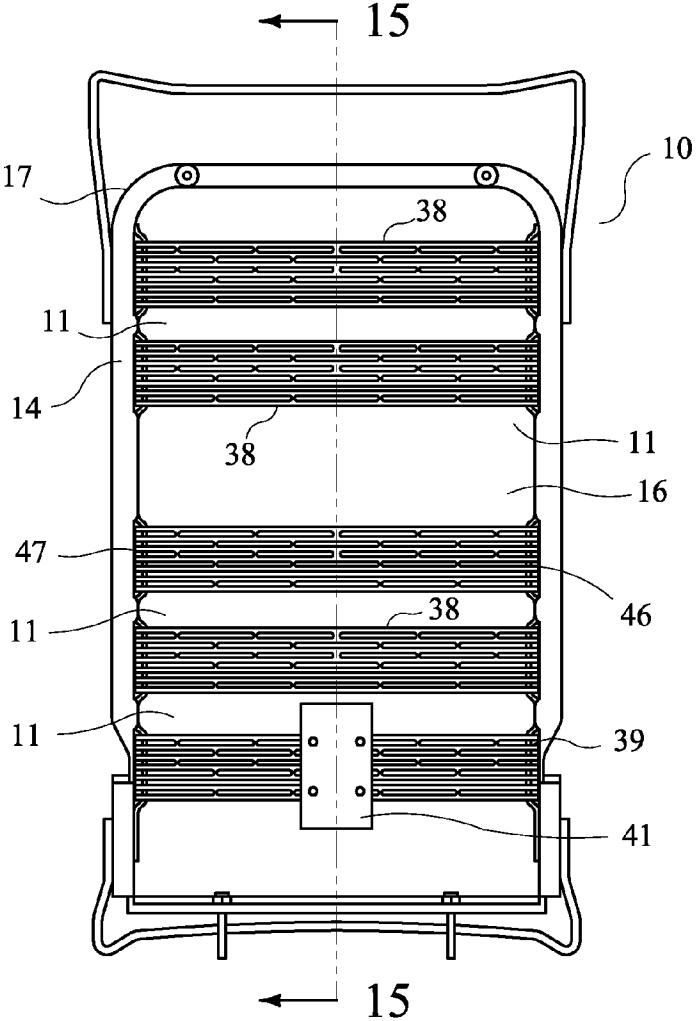
FIG. 11 is a front view of one embodiment of the body support assembly incorporated into a back portion of a chair.

For example, as shown in FIG. 5, a seat portion 15 and a back portion 17 form part of a chair 13. The body support assembly 10 may form part of the back portion 17, as shown in FIG. 11. In this embodiment, a continuous frame member 14 supports a membrane 11 disposed across the opening 16. FIG. 15 is a cross-sectional side view taken along the line 15-15 of the back portion 17 of the chair 13 of FIG. 11. As shown, the frame member 14 may have a wave-like shape to fit the contour of the user's spine.

Figure 7:
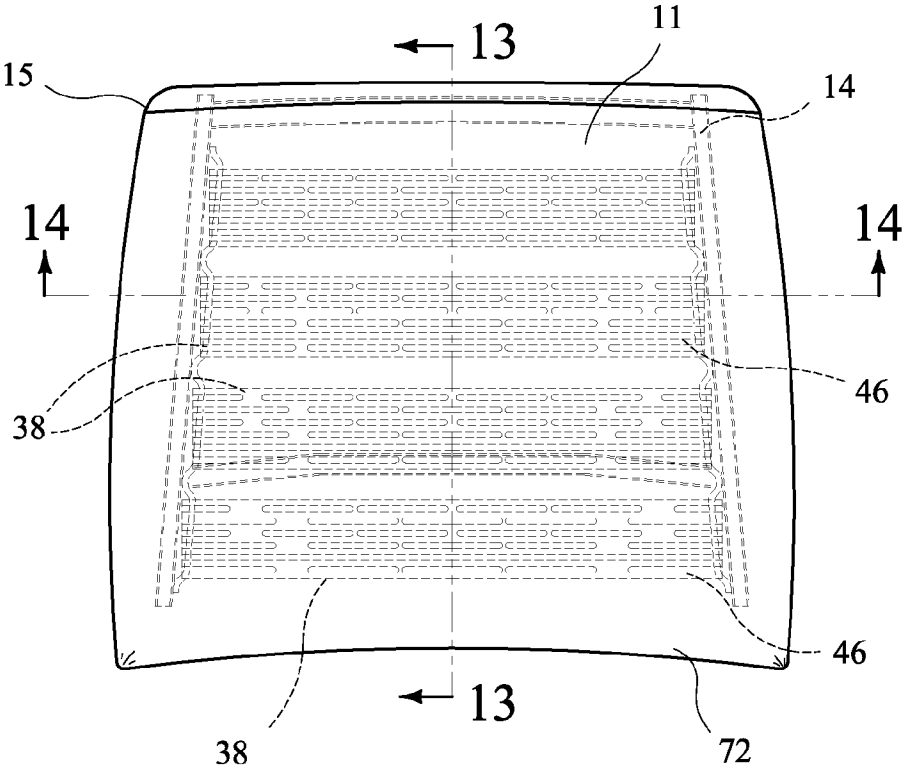
FIG. 7 is a perspective view of one embodiment of the body support assembly incorporated into a seat portion of a chair and encapsulated by a cushion material.
Figure 12:
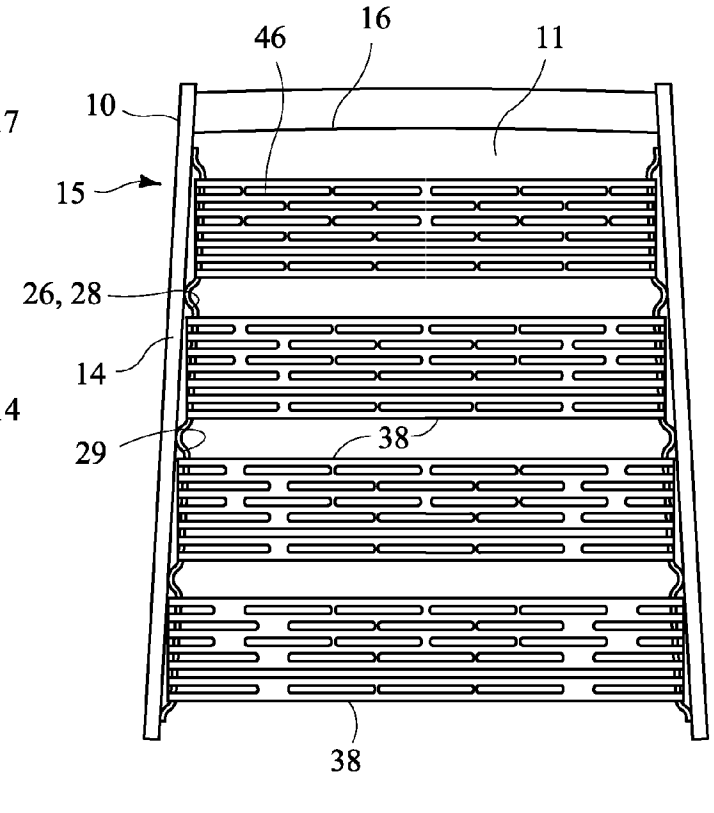
FIG. 12 is a perspective view of one embodiment of the body support assembly incorporated into a seat portion of a chair.

Similarly, as shown in FIGS. 7 and 12, the body support assembly 10 may also form part of the seat portion 14, with an arrangement of a plurality of frame members 14 forming the opening 16. The membrane 11 is disposed across the opening 16, and may be encapsulated, as shown in FIG. 7, by a cushion material, such as foam 72.

Referring back to FIG. 1, the opposing frame members 14 are generally parallel to one another. However, such an orientation is not necessary, and the support structure 12 may have more or less frame members 14 than as illustrated in FIG. 1. The support structure 12 may be configured as a single, integrally formed frame member 14 as shown in FIG. 11, or be formed from a plurality of separate frame members 14.

In one embodiment, the support structure 12 has a first frame member 18 which is substantially parallel to a second frame member 20, and a third frame member 22 substantially parallel to a fourth frame member 24. The first and second frame members 18, 20 are generally perpendicular to the third and fourth frame members 22, 24. However, the number and orientation of the frame members 14 with respect to one another is application dependent. The frame members 14 may be attached to one another through conventional attachment devices, including without limitation, welding, adhesives, mechanical fasteners, or the like, and combinations thereof.

Figure 2:
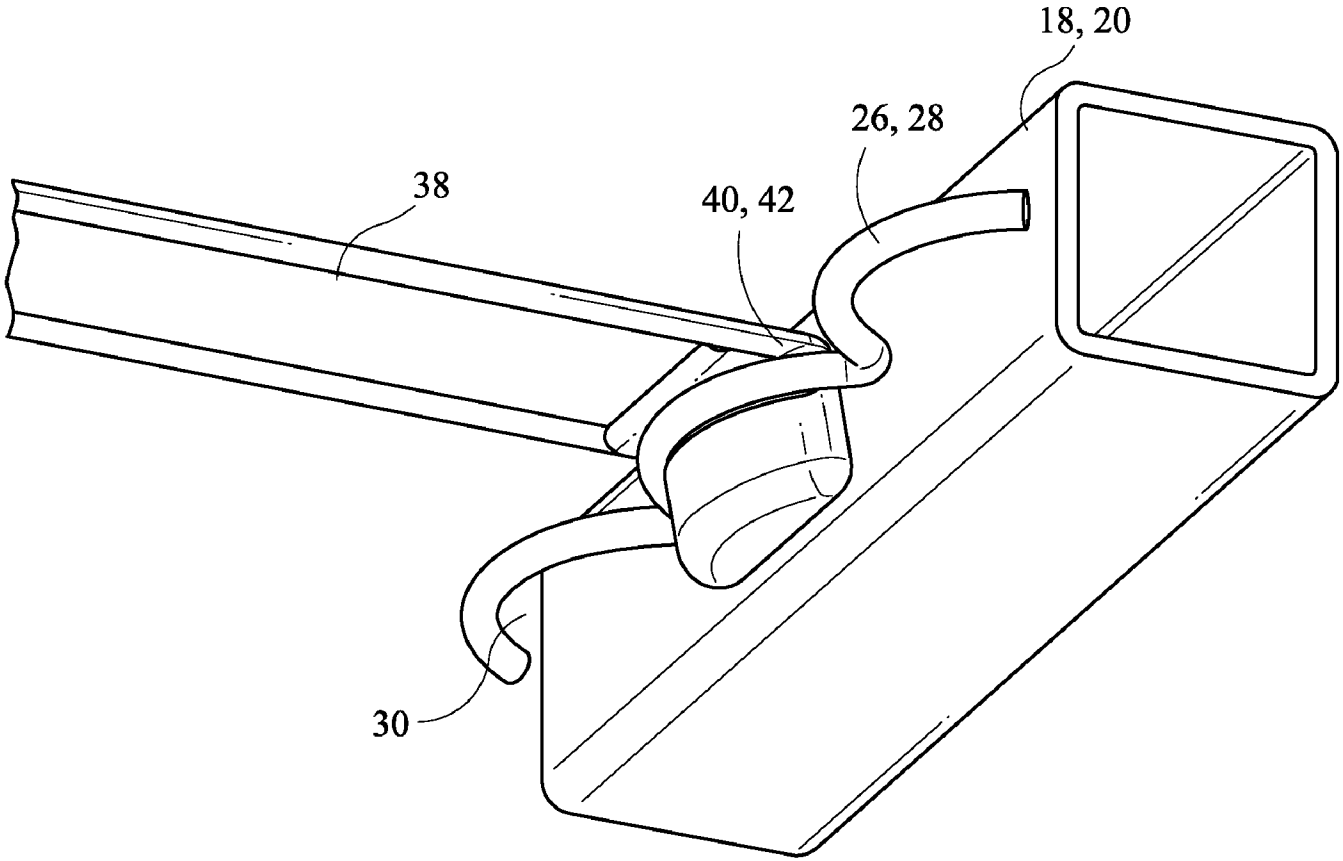
FIG. 2 is an exploded view of one embodiment of the support bracket of the present invention.

As further shown in FIG. 2, the first and second frame members 18, 20 have a generally rectangular cross-section, and may be made out of a metal, wood, composite, alloy, or any other suitable material. The size and cross-sectional shape of all the frame members 14 may vary.

Referring back to FIG. 1, a retaining structure 26 is coupled with the first and second frame members 18, 20. In one embodiment, also shown in FIG. 12, the retaining structure 26 is formed by a wire 28 forming a plurality of loops 29. The cross-section of the wire can be circular, rectangular, oval, triangular, or any other suitable shape. The retaining structure 26 is disposed at least partially along the length of the first and second frame members 18, 20. The retaining structure 26 may be attached to the first and second frame members 18, 20 through any conventional attachment device, including without limitation, welding, mechanical fasteners, tabs, shape fit, and/or any combination thereof. In addition, the retaining structure 26 may also be integral with the first and second frame members 18, 20 and form part thereof. Independent of how the retaining structure 26 is formed and/or attached, the retaining structure 26 may be configured as a plurality of independent structures extending along and secured to the frame members 18, 20, or may be configured as one continuous structure, as shown in FIG. 1.

Figure 3:
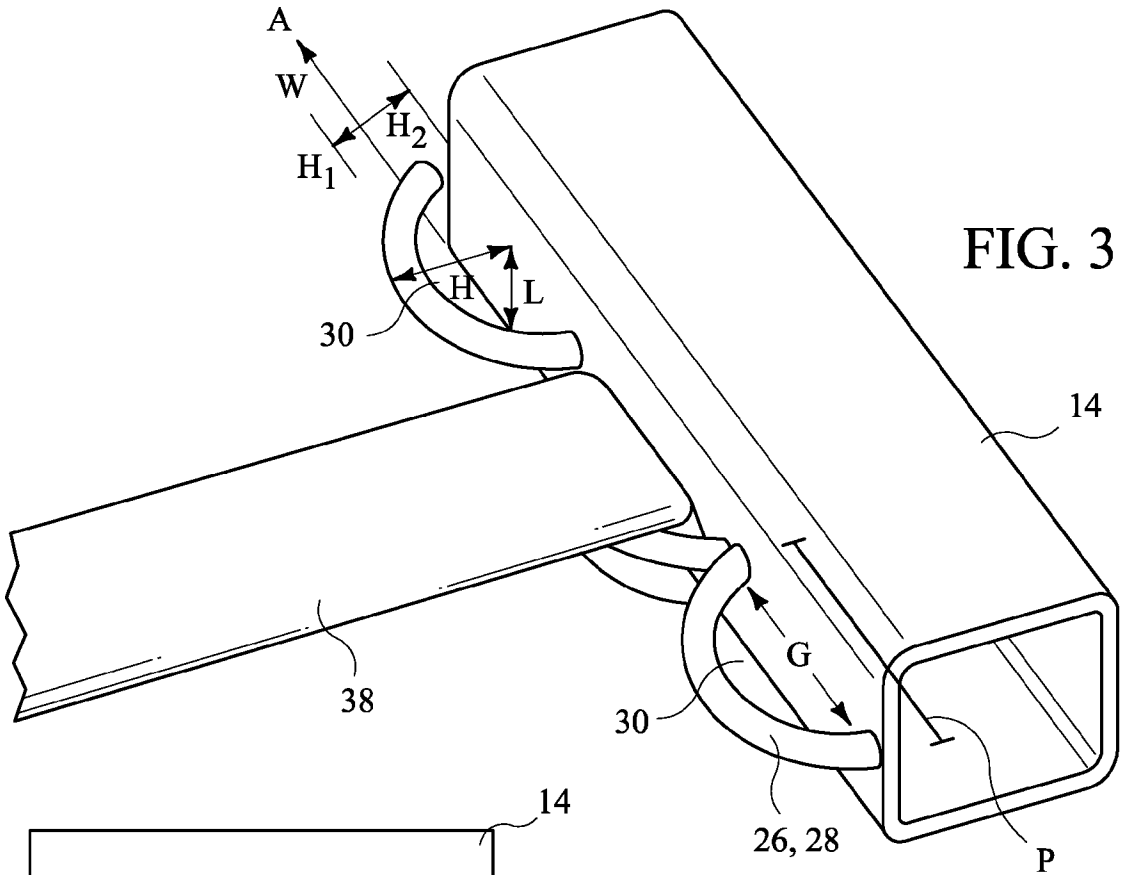
FIG. 3 is a perspective view of another embodiment of the support bracket of the present invention.
Figure 4:
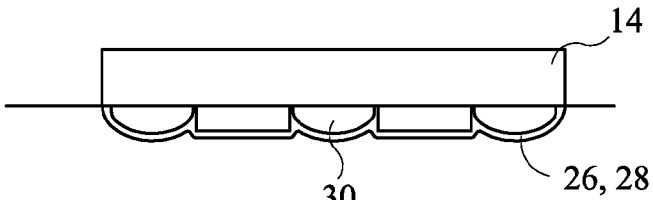
FIG. 4 is a front view of yet another embodiment of the support bracket of the present invention.
Figure 6:
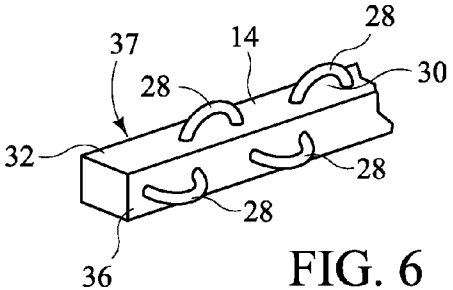
FIG. 6 is a perspective view of yet another embodiment of the support bracket of the present invention.

As shown in FIG. 3, the retaining structure 26, configured as the wire 28, is defined by a longitudinal axis A. The wire 28 oscillates in a boustrophedonic, or varying, fashion between a first height H1 and a second height H2, as measured from the longitudinal axis A. The frame member 14 may not be linear, and in that event, H1 and H2 can be measured from a centerline defined by the curvature of the member 14 instead of the longitudinal axis A. It can be appreciated that the shape of the wire 28 may vary and may not be consistent within a single embodiment. For example, the wire 28 may take on a rectangular-shaped pattern, as shown in FIG. 1, or may alternate between patterns, as shown in FIG. 4. In addition, the location of the wire 28 may vary. By way of example, the wire 28 may not be between the first and second members 18, 20 as shown in FIG. 1, but may be below, above, or on an outside of each respective member 18, 20. The wire 28 may be attached to a top 32, a bottom 34, or an exterior 37 of the member 14. Indeed, the pattern and location of the wire 28 may need not be consistent in a single application either, and may vary on a single member 14 or between members 14. For example, FIG. 6 illustrates a wire 28 forming one opening 30 on the top 32 and another one on the interior 36 of the member 14.

In one embodiment, as shown in FIG. 3, the wire 28 has an approximate diameter of 0.10-0.20 inches thick, and forms an opening between the frame member 14 which has a maximum height (H) of approximately 0.30 inches and a gap (G) of approximately 2.625 inches. The wire 28 has a minimum bend radius (r) of 0.1 inches, with a period (P) of approximately 3.5 inches. The specific measurements, of course, may vary depending on factors such as the size and shape of the retention portion, anticipated load and the frequency of its application.

It is important to note that the respective heights, as measured from the longitudinal axis A, need not be equivalent, or consistent, along the length of the first and second frame members 18, 20, so long as the shape of the wire 28 generally defines at least one opening, or aperture 30, between the frame member 14 and the wire 28. In this embodiment, the shape of the wire 28 forms a series of openings 30 along the length of the first and second members 18, 20, as shown in FIG. 1. In this embodiment, the plurality of openings 30 formed on the first member 18 correspond to the plurality of openings 30 formed on the second member 20. The configuration of the openings 30, however, may vary and is dependent on the intended application. Indeed, the openings 30 may also be formed within the frame member 14 itself.

A strap 38 is disposed across the opening 16, and between the first and second frame members 18, 20. The strap 38, as better shown in FIGS. 1 and 5, has a first end 40 and a second end 42. The strap 38 may also have a series of elongated apertures 46 formed therein between the first 40 and second 42 ends, as shown in FIGS. 7, 9, 11 and 12. As referred to herein, an "aperture" may disposed entirely through the strap 38 and form an opening therethrough, or may only be disposed partially through the strap 38 such that the aperture does not form an opening therethrough. The elongated apertures 46 reduce the amount of material required to construct each strap 38, without sacrificing its physical characteristics. It can be appreciated that the apertures 46 may be of any shape, such as oval, circular, or the like. The apertures 46 may also vary in size, length, and may have asymmetrical or symmetrical patterns.

The apertures 46 formed within the strap 38 also facilitate the process of encapsulating the straps 38 with a cushion material 72. For example, and without limitation, foam openings, or apertures 46, also can be sized and positioned to optimize the stretch and flexibility properties of the straps 38, individually and collectively. The size, location and overall configuration of the apertures 46 can be optimized to allow the cushion material 72 to be disposed through the apertures 46 to encase, and secure, the strap 38, or membrane 11, on both faces of the strap 38, or membrane 11. In one embodiment, straps 38 may have an aperture 46 with a minimum gap for foam encapsulation of 0.250 inches wide by 1.50 to 2.75 inches long. The cushion material 72 functions to lock the crystalline structure, fibers, or filament of the membrane 11, or strap 38, together to provide for the desired distribution of seating loads throughout the membrane 11 and to avoid areas of stress concentration. The cushion material 72 also functions to shrink the membrane 11 to further induce tension in the membrane 11 and insure its ability to comfortably resist seating loads. The cushion material 72 can be of any suitable foam material such as a urethane foam.

Figure 13:
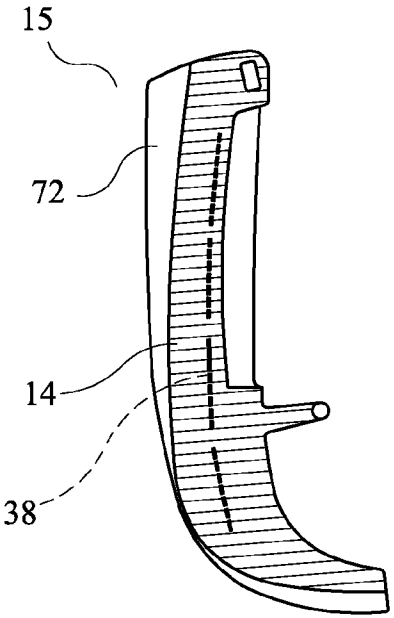
FIG. 13 is a side cross-sectional view of the body support assembly incorporated into a seat portion of a chair shown in FIG. 7 as taken along line 13-13.
Figure 14:
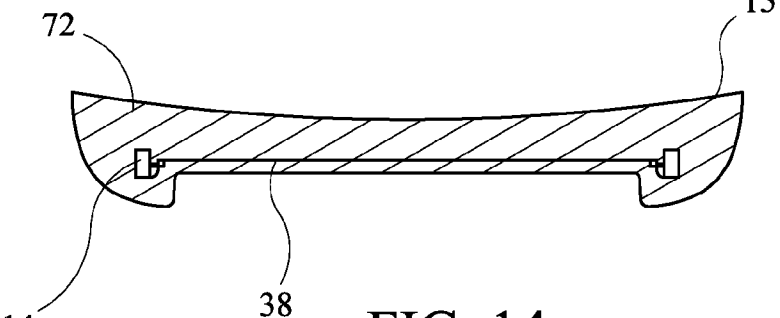
FIG. 14 is a front cross-sectional view of the body support assembly incorporated into a seat portion of a chair shown in FIG. 7 as taken along line 14-14.

The cushion material 72 may encapsulate, and form part of, the seat 15 as shown in FIGS. 7, 13, and 14. FIG. 7 illustrates a perspective front view of the cushion material 72 disposed substantially around the membrane 11. FIGS. 13 and 14 represent the cross-sectional views of the seat 15 shown in FIG. 7 taken along the 13-13 and 14-14 lines, respectively.

Figure 18:
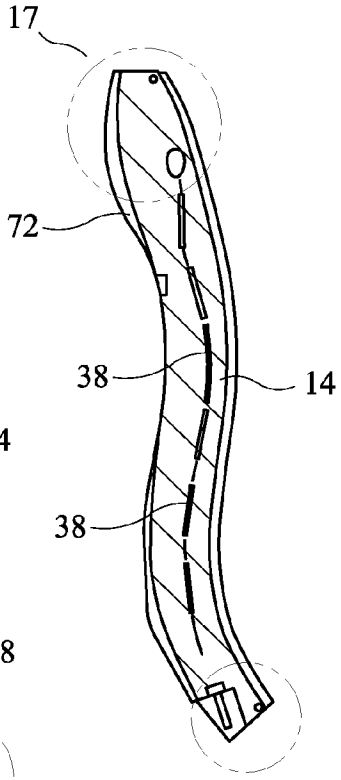
FIG. 18 is another side cross-sectional view of the body support assembly incorporated into a back portion of a chair shown in FIG. 16 as taken along line 18-18.
Figure 17:
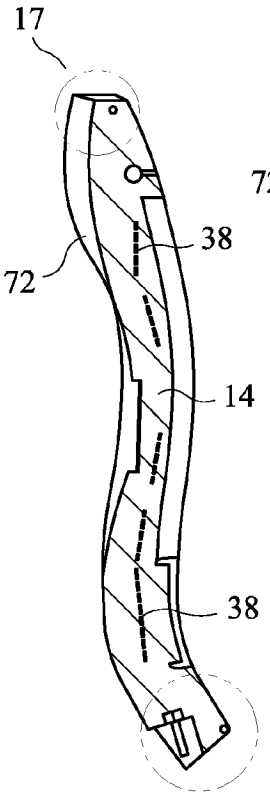
FIG. 17 is a side cross-sectional view of the body support assembly incorporated into a back portion of a chair shown in FIG. 16 as taken along line 17-17.
Figure 16:
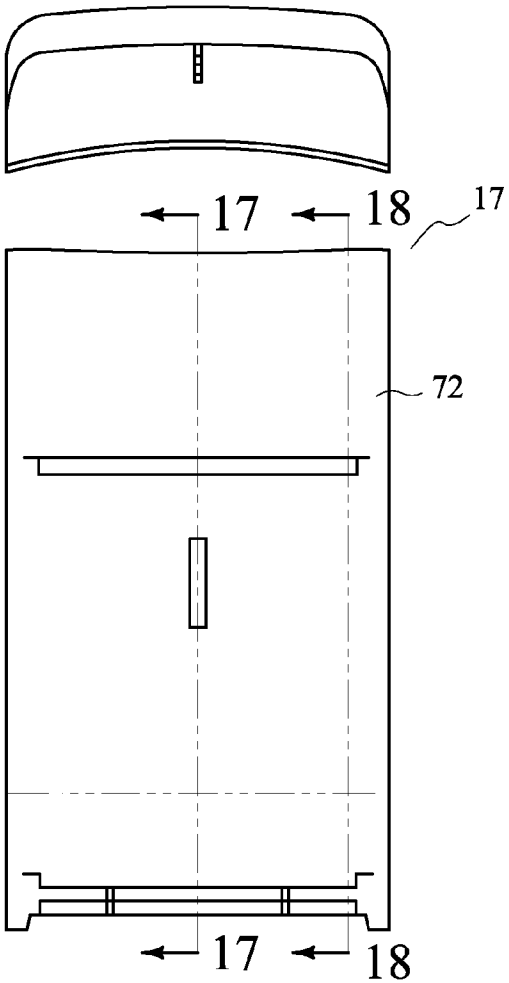
FIG. 16 is a front view of one embodiment of the body support assembly incorporated into a back portion of a chair and encapsulated in a cushion material.

Similarly, the cushion material 72 may also encapsulate, and form part of, the back 17 as shown in FIGS. 16-18. As shown in FIG. 16, the cushion material 72 covers substantially the entire membrane 11. FIGS. 17 and 18 are cross-sectional views taken along lines 17-17 and 18-18, respectively, which illustrate the membrane 11 being substantially covered by the cushion material 72.

Figure 20:
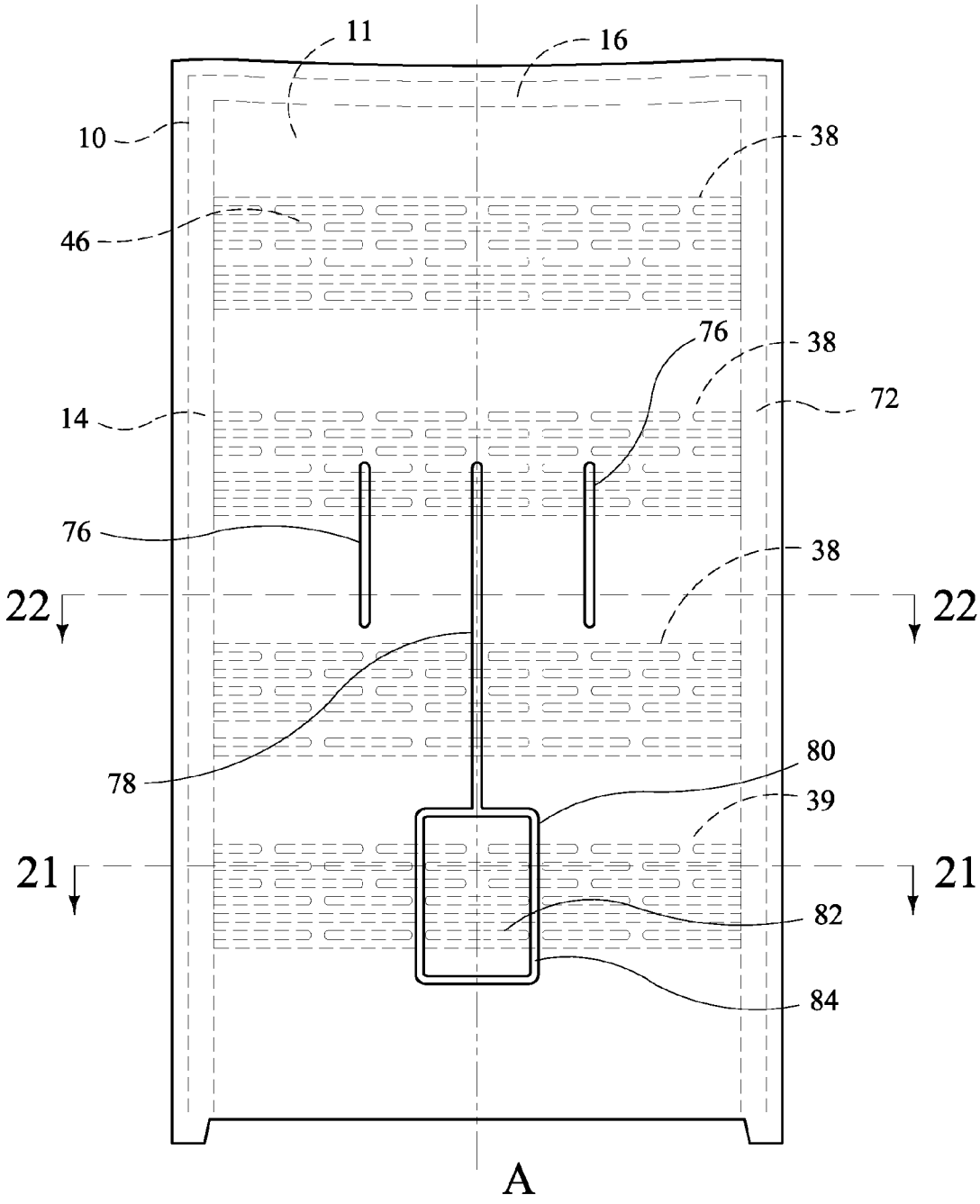
FIG. 20 is a back view of one embodiment of the body support assembly incorporated into a back portion of a chair and encapsulated in a cushion material.

In an alternative embodiment, as shown in FIG. 20, the cushion material 72 may also contain one or more relief channels 74 formed within the surface of the cushion material 72. For completeness, FIG. 20 also depicts the straps 38 and apertures 46 in dashed lines and one embodiment of their respective locations with respect to the relief channels 74. The relief channels 74 reduce the restrictive nature of the cushion material 72 when a load is applied and permits the membrane 11 to react more freely in response to the load. In other words, the relief channels 74 break the surface tension of the cushion material 72, and permit the cushion-encapsulated membrane 11 to behave in a manner more similar to a non-capsulated membrane 11, thereby increasing the amount of deflection exhibited by the membrane 11. As shown in FIG. 20, multiple relief channels 74 may be formed within the surface of the cushion material 72, and may be incorporated into any portion, or surface, of any body support assembly.

Figure 22:
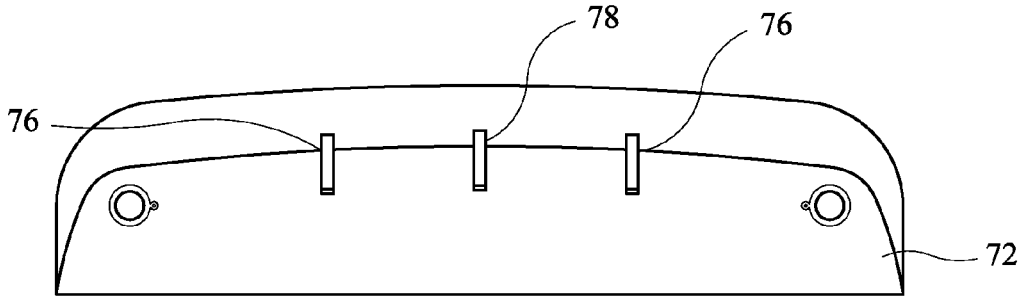
FIG. 22 is another cross-sectional view of a back portion of a chair encapsulated in a cushion material as shown in FIG. 20 as taken along line 22-22.
Figure 23:
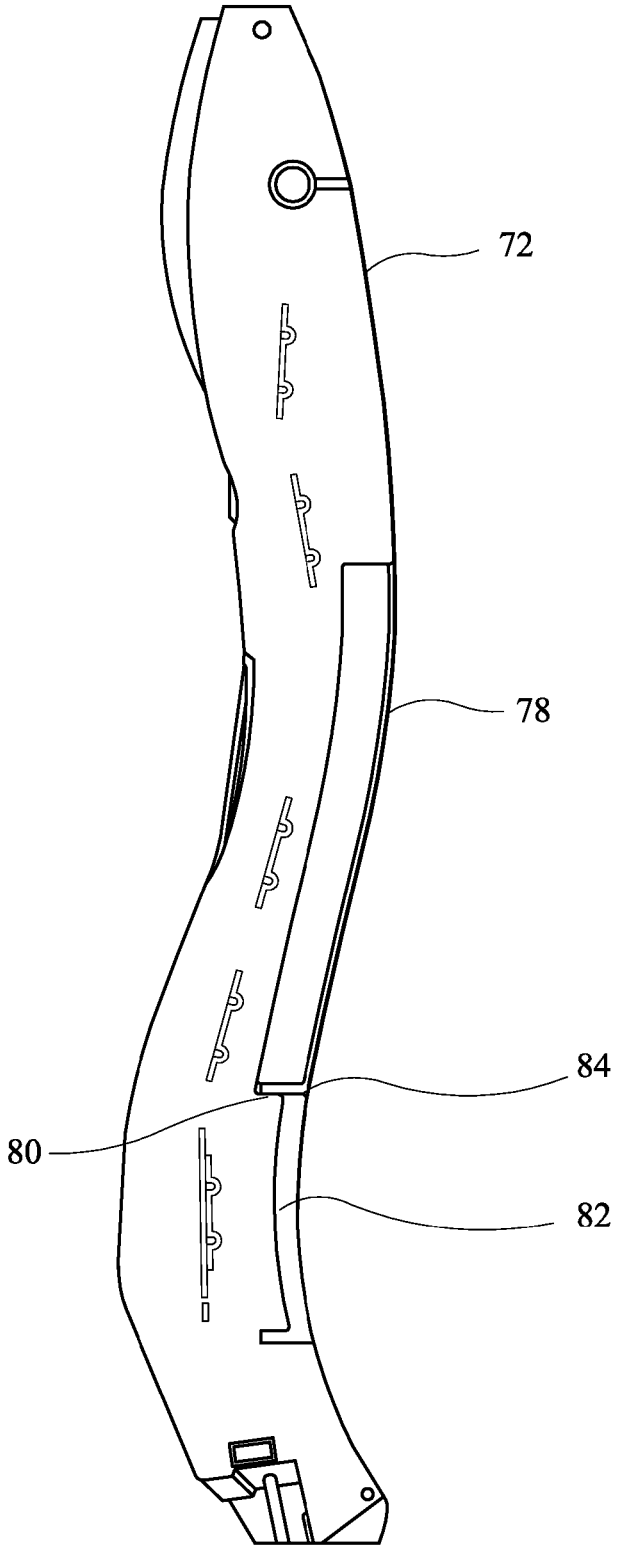
FIG. 23 is yet another cross-sectional view of a back portion of a chair encapsulated in a cushion material as shown in FIG. 20 as taken along the longitudinal axis A.

The relief channels 74 may be positioned anywhere along the cushion material and may be placed in locations requiring greater deflection to provide enhanced comfort. For example, in one embodiment, as shown in FIGS. 20 and 22, an upper set of relief channels 76 may be positioned at a location corresponding to user's upper back, specifically at the t10/t12 spine vertebra and a center relief channel 78 may be disposed along the centerline of the cushion material 72, along the longitudinal axis A which corresponds to the user's spinal column. FIG. 22 is a cross-sectional view of FIG. 20 taken along line 22-22, which shows the spatial relationship with respect to the upper set of relief channels 76 and the center relief channel 78. FIG. 23 is a cross-sectional view of the center relief channel 78 taken along the longitudinal axis A as shown in FIG. 20. In this embodiment, the straps 38 run along the X direction and the channels 74 are transverse, for example substantially perpendicular, to the straps 38 of the membrane 11. However, the straps 38 may run in any other direction, such as the Y direction, and the channels 74 may be orientated in any other direction or angle relative to the straps 38, such as being parallel to the straps 38.

Figure 21:
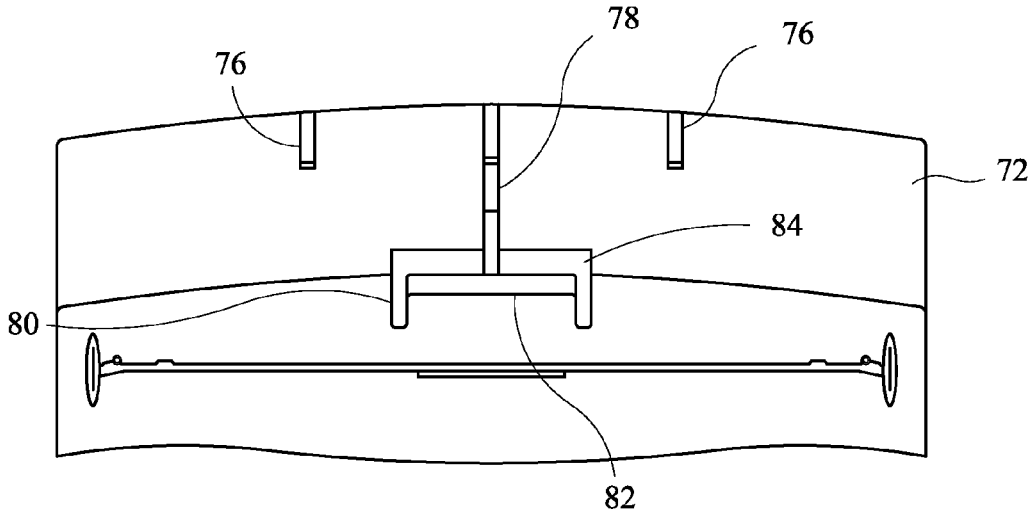
FIG. 21 is a perspective cross-sectional view of a back portion of a chair encapsulated in a cushion material as shown in FIG. 20 as taken along line 21-21.

The relief channels 74 may be disposed in any direction with respect to the longitudinal axis A, and may be connected to one another to form a relief zone. For example, as further shown in FIGS. 20 and 21, a lower set of relief channels 84 form a rectangle 80 at the lumbar portion of the user's back. Specifically, FIG. 21, which is a perspective cross-sectional view of FIG. 20 taken along line 21-21, and FIG. 23 better illustrate how the center relief channel 78 is connected to the lower set of relief channels 84. The location of the rectangle 80 forms a lumbar zone 82, which corresponds to the location of a passive lumbar member 41 of the back portion 17 of the chair 13, as shown in FIG. 11. The lumbar zone 82 allows for the increased deflection, and response to a load, by the membrane 11.

The dimensions of the relief channels 74 may vary; however in one embodiment, the relief channels 74 have a width of approximately 7 mm, with the upper relief channels 76 each having a length of approximately 155 mm and are located approximately 90 mm away from the longitudinal axis A in the X direction. The center relief channel 78, located along the longitudinal axis A, may have a width of approximately 7 mm and a length of approximately 310 mm. The area of the rectangle 80 formed by the relief channels 72 may have an approximate width of 105 mm and an approximate height of 151 mm along the longitudinal axis A. The depth of the relief channels 74 is such that there is approximately 12 mm of foam between the bottom of the channel 74 and the membrane 11. Additionally, the depth of the relief channels 74 may further vary such that there is anywhere between 5 to 20 mm of foam between the bottom of the channel 74 and the membrane 11. In another embodiment, the depth of the relief channel 74 may range from 10 to 15 mm of foam between the bottom of the channel 74 and the membrane 11. Alternatively, the depth of the relief channels 74 may also be equal of the thickness of the cushion material 72, and therefore may form an aperture completely through the cushion material 72, or may be equal to half of the thickness of the cushion material 72 and therefore may form an aperture up to the membrane 11.

Figure 9:
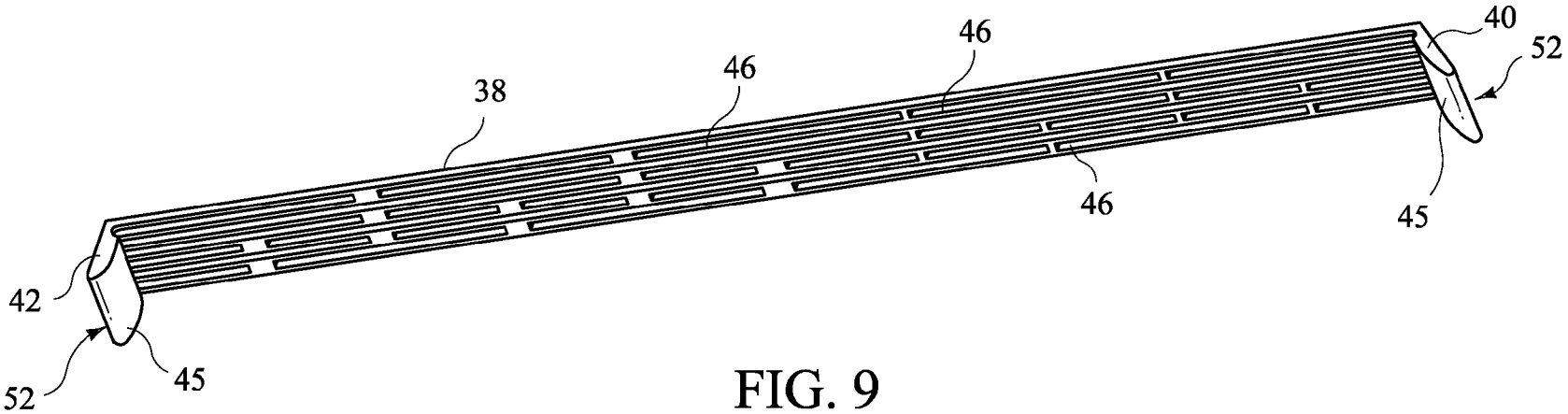
FIG. 9 is a perspective view of one embodiment of the strap of the present invention.

The apertures 46 permit a specific amount of extension of the strap 38, or membrane 11, in the desired direction without significant stretching of the strap 38, or membrane 11. The apertures 46 may be elongated as shown in FIGS. 7, 9, and 12 and may be staggered across each strap 38 or membrane 11, with the precise shape, number, location, and size of the apertures 46 being dictated primarily by the desired support characteristics. The strap 38 may be molded with a bead around each aperture 46 to reduce the possibility of tearing.

In the embodiment shown in FIG. 2, the first and second ends 40, 42 generally extend downward and are configured to fit within the openings 30 formed by the wire 28, such that the strap 38 spans at least partially across the opening 16. The first and second ends 40, 42 are also known as retention portions, which are configured to retain the strap 38 within the opening 30 formed by the wire 28. In one embodiment, the ends 40, 42 of the strap 38 may take on a shape similar to that of the opening 30, and therefore may have a rectangular shape, semi-spherical shape, or the like. The membrane 11 is generally formed through the use of multiple straps 38 spanning at least partially across the opening 16, as shown in FIG. 1. However, the membrane 11 may be formed as a single integral member extending across the opening 16 of the support structure 12 having a series of retention portions 40, 42 disposed along the unitary membrane 11. Independent of the configuration, the straps 38 can span in one or both of the X and Y directions.

Figure 24:
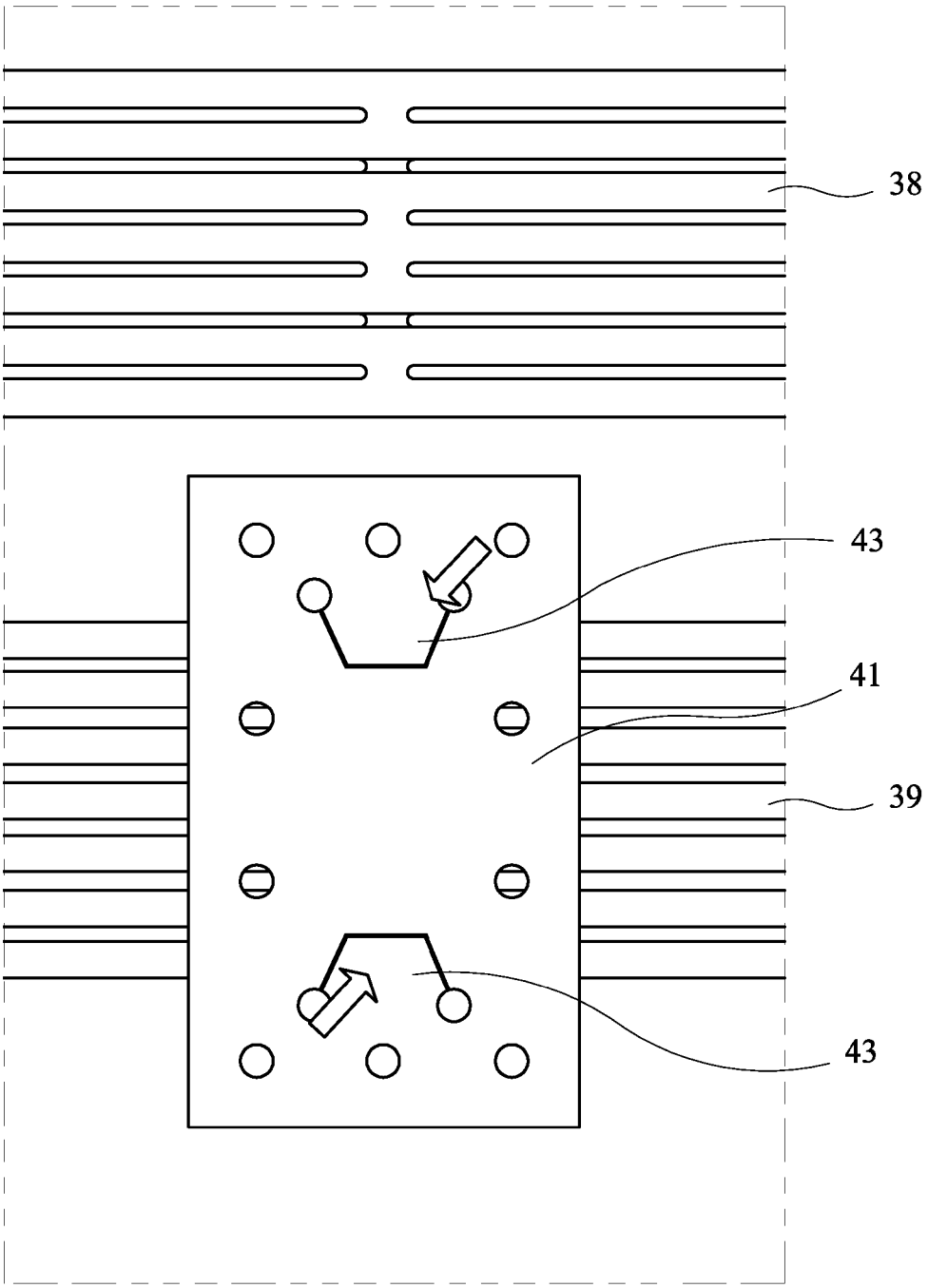
FIG. 24 is another front view of one embodiment of the body support assembly incorporated into a back portion of a chair.

The straps 38, in the embodiment shown in FIG. 1, are generally adjacent to, and parallel with, one another. It can be appreciated that the number, orientation, size, and shape of the straps 38 may vary and is application dependent. For example, the embodiment in FIG. 1 includes seven straps 38 disposed across the opening 16. In another example, shown in FIG. 11, the membrane 11 is formed from five straps 38 disposed across the opening 16 in the X direction. In this particular embodiment, the membrane 11 forms part of the back portion 17 of the chair 13, where the lowermost strap 39 is coupled with the passive lumbar member 41. As shown in FIG. 24, the passive lumbar member 41 has two tabs 43 which connect the member 41 to a portion of the lowermost strap 39. The passive lumber member 41 may be secured to the lowermost strap 39 by any other suitable means, such as adhesive or any suitable mechanical fasteners, such as a nut and bolt configuration. The passive lumbar member 41 is meant to pivot with the strap 39 and provides support to the lumbar portion of the user's back. The third lowermost strap 47 is specifically positioned along the frame members 14 to provide comfort to the user's upper back, specifically at the t10/t12 spine vertebras.

In the illustrated embodiment, the straps 38 of the membrane 11 are molded from a thermoplastic polyether ester elastomer block copolymer. Suitable materials of this type include that available from DuPont under the Hytrel® trademark, and that are available from DSM under the Arnitel® trademark. A variety of alternative elastomers may be suitable for use in the present invention. The thickness of the molded membrane 11 will vary from application to application, depending primarily on the anticipated load and the desired stiffness of the surface. In standard seating applications, the support portion of the membrane 11 may have an average thickness prior to any desired orientating of approximately 20-40 mils. In one embodiment, the strap(s) 38 forming the molded membrane 11 is orientated in one direction (i.e. the X direction) to provide creep resistance and elasticity in the direction of orientation. For ease of reference, it is contemplated that the term "membrane" 11 may mean an individual strap 38 or plurality of straps 38 which can be orientated in different arrangements. The membrane 11 is orientated by increasing the alignment of the crystalline structure of the elastomeric membrane 11 on a molecular level so that its support and other load baring characteristics are altered. Typically, the membrane 11 is orientated to such a degree that the orientated membrane 11 has a materially different load bearing characteristics in the orientated direction than in other directions.

One method for orientating the membrane 11 is through stretching. The amount of stretch required to obtain the desired alignment will vary from application to application, but in most applications the desired degree of alignment will occur when the membrane 11 is stretched to roughly two times its original dimension. Although the elastomeric membrane 11 may be orientated by stretching the membrane 11, it may be possible in some applications to orient the membrane 11 using other processes. For example, it may be possible to orient certain material by hammering or other forms of compressions rather than stretching the membrane 11. It should be noted that many elastomeric materials, including molded Hytrel®, have essentially no elasticity and are susceptible to a high degree of creep when in a molded form. The orientation process of the present invention causes a significant change in the properties of the elastomeric material. For example, orientation of the membrane 11 increases the elasticity of the material and decreases its inherent susceptibility to creep.

As noted above, the elastomeric membrane 11, or each strap 38, is molded using conventional techniques and apparatus. For example, the elastomeric membrane 11 may be injection molded using a conventional injection molding apparatus having a die that is configured to provide a membrane with the desired shape and features. In this embodiment, the elastomeric membrane 11 is manufactured by injecting the desired material into the die cavity. The die is designed to provide a molded blank that will take on the desired shape once any desired orientation has taken place. For example, the dies are configured to form a part that will have the desired shape and dimensions after the orientation step is complete. After molded, the membrane 11, or each individual strap 38, may be stretched or otherwise orientated in one direction. If orientation is achieved through stretching, the precise amount of stretch to be applied to a given membrane 11, or strap 38, will depend on the configuration of the membrane 11 and the desired support characteristics. In many applications, it will be necessary to stretch the membrane to at least twice its original length to achieve the desired alignment. The membrane 11 may be stretched using conventional techniques and apparatuses. As a result of the increase in alignment of the crystalline structure, the membrane 11, or each strap 38, will not fully return to its original length after being released from the stretching equipment. Rather, the orientated membrane 11 will be elongated a certain portion of the stretched distance, with the precise amount of elongation being dependent in part on the material characteristics of the membrane material. Once any desired orientation has taken place, the membrane 11 can be mounted directly to the support structure as described herein. Various aligned materials and structures are disclosed in U.S. Publication No. 2005/0279591, published Dec. 22, 2005, U.S. Publication No. 2006/0267258, published Nov. 30, 2006, and U.S. Publication No. 2006/0286359, published Dec. 21, 2006, the entire disclosures of which are hereby incorporated by reference.

As an alternative to stretching, the membrane 11 may be orientated by compression. In one embodiment, the membrane 11, or each strap 38, is placed in a die or other structure that constrains the membrane 1l1 on all sides other than at least one side that corresponds with the desired direction of orientation. Opposed sides may be unconstrained to permit the material of the membrane 11 to flow from both sides along the direction of orientation. Alternatively, only a single side may be constrained, thereby limiting material flow to a single side. A compressive force is then applied to the membrane 11. For example, a press can be used to compress the membrane 11 within the die. Sufficient compressive force is applied so that the material begins to flow in the unconstrained direction. This, in effect, causes the membrane 11 to extend and its crystalline structure to become increasing aligned in the direction of orientation. The amount of force applied to the membrane 11 may vary from application depending on the desired degree of alignment or orientation. Each individual strap 38 forming the membrane 11, if more than one strap 38 exists, may be individually orientated. Moreover, in some applications, it may be desirable to orient only select peripheral portions of the membrane 11 or strap 38. When desirable, this may be achieved by applying localized stretching or localized compression of the membrane 11 or each strap 38.

Figure 8:
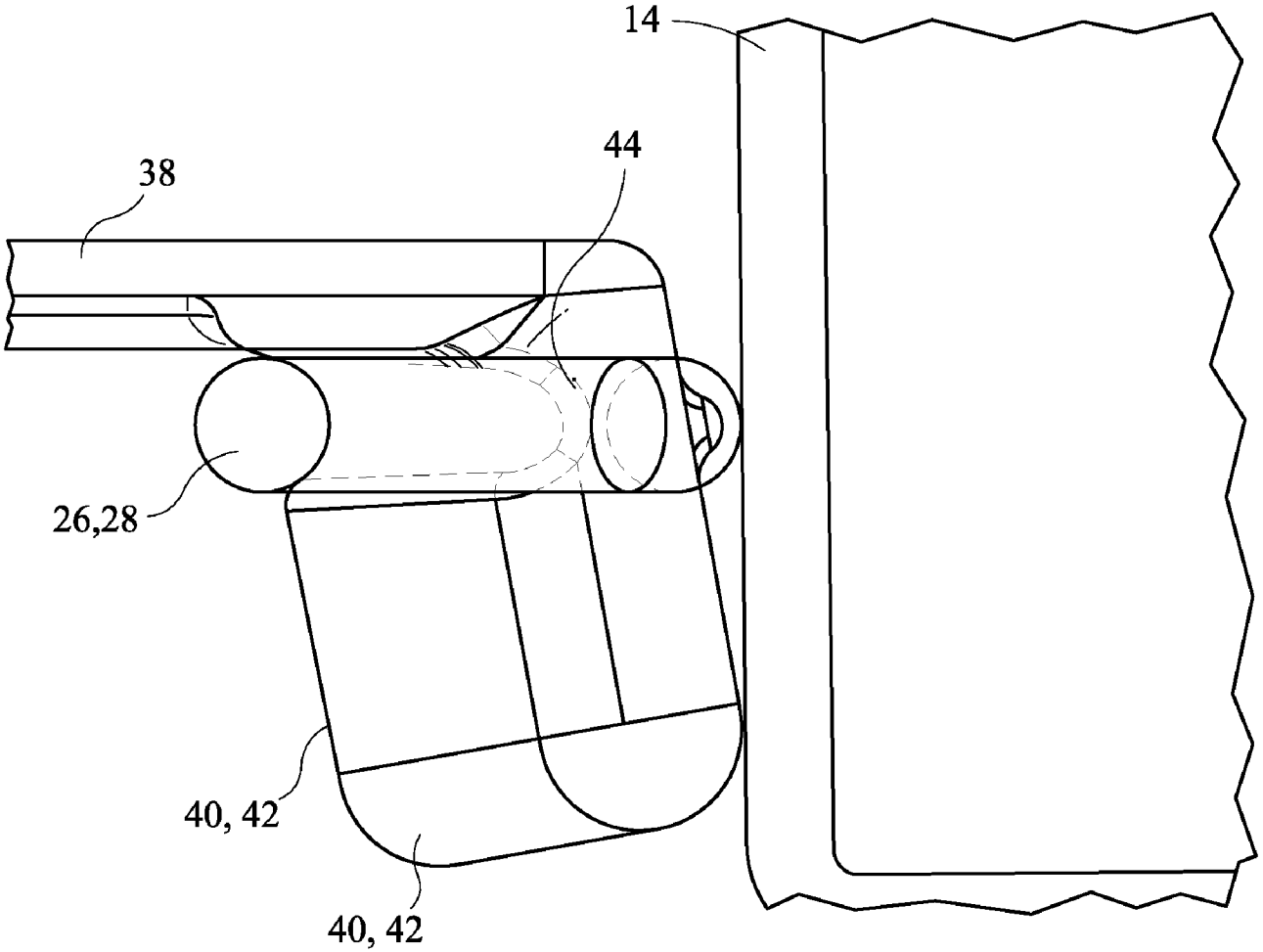
FIG. 8 is a fragmentary view of one embodiment of the support bracket of the present invention.

In one embodiment, the straps 38 each have a generally rectangular cross-section as shown in FIG. 8. In addition, as shown in FIGS. 2 and 8, the first and second ends 40, 42 of the strap 38 define a recessed portion 44 having a shape, e.g. concave, complimentary to that of the wire 28, e.g. curved, such that a portion of the wire 28 can be seated within the recessed portion 44 of the strap 38. The recessed portion 44 helps secure the strap 38 to the member 14. In this embodiment, the retaining portions 40, 42, have a larger cross-sectional area than that of opening 30 of the wire 28 to ensure a secure fit.

Figure 10:
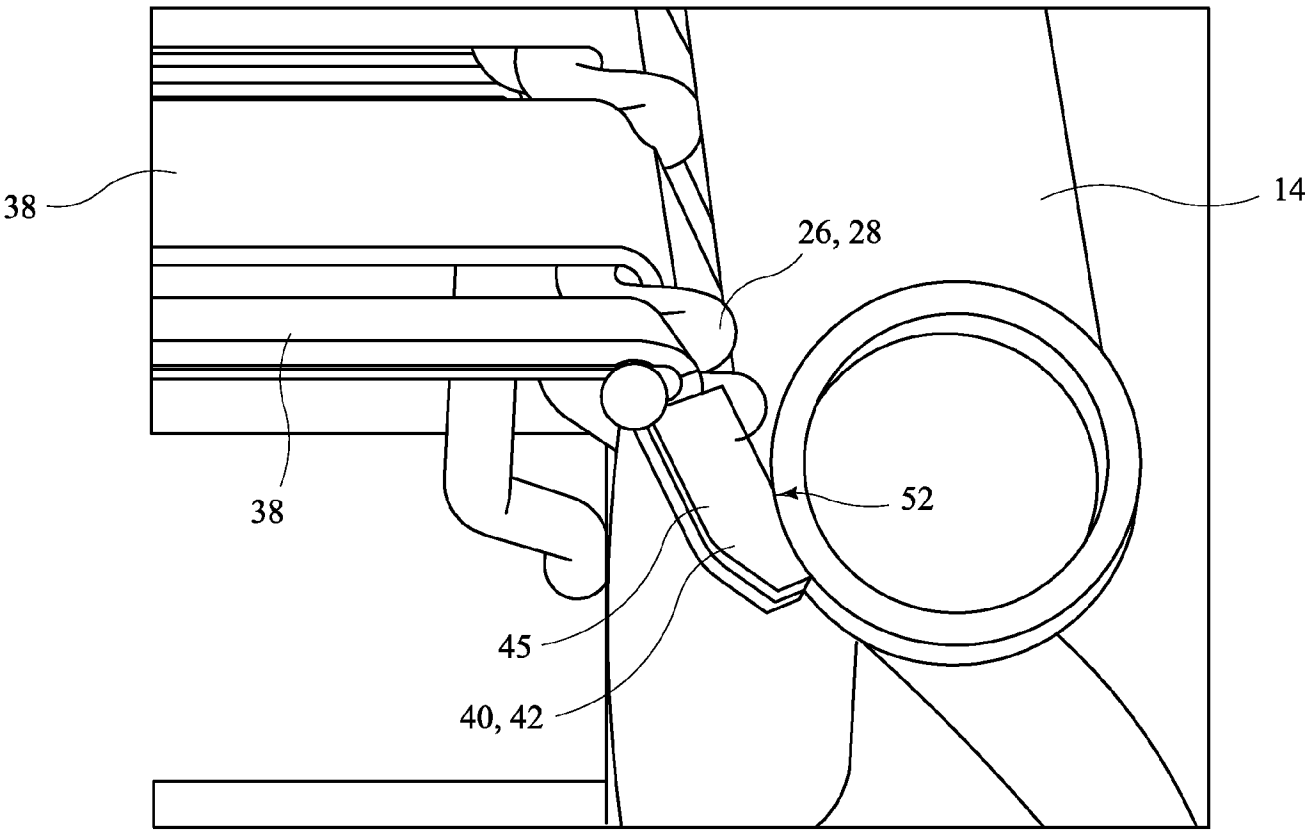
FIG. 10 is a fragmentary view of one embodiment of the body support assembly.
Figure 19:
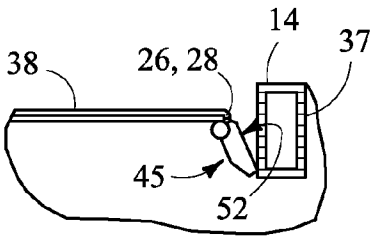
FIG. 19 is a fragmentary view of one embodiment of the body support assembly.

As shown in FIGS. 9, 10, and 19 the ends 40, 42 of the strap 38 may have an enlarged portion 45, which secures the wire 28 within each respective end 40, 42. The enlarged portion 45 has a first side 52 that is adjacent to the frame member 14, as shown in FIGS. 10 and 19. When a load is applied to the membrane 11, each strap 38 deflects in the direction of the force. The degree of deflection is, at least in part, governed by the physical characteristics of the strap 38 and the amount of applied force. One way to control the degree of deflection is by changing the thickness and shape of the enlarged portion 45. The wire 28 acts like a pivot point when a force is applied to the membrane 11, which causes the ends 40, 42 of each strap 38 to rotate about the loop, or wire 28, and displace in a direction opposite from the direction of the force. The ends 40, 42 will pivot with respect to the wire 28, but will not decouple from the wire 28. If the geometry of the portion 45 is such that the first side 52 is adjacent to, and in contact with, the frame member 14, the opposing reactive force exerted on the enlarged portion 45 by the frame member 14 will limit the rotation of the ends 40, 42, and resulting degree of deflection of the strap 38. By changing the geometry of the enlarged portion 45, the thickness of the wire 28, or the spacing between the loops of the wire 28, the degree of deflection can be modified. It is also contemplated that the magnitude and location of the reaction and opposing forces will be governed, in part, by the specific geometry of the strap 38 and the connecting member 16.

As shown in the embodiment in FIG. 8, the ends 40, 42 of the strap 38 are further locked to, or wedged within, the aperture 30 formed by the wire 28 as the strap 38 is stretched across the opening 16. The axial forces, along the X direction, resulting from the stretching process cause the ends 40, 42 of the strap 38 to wedge itself against the frame member 14 and the wire 28, thereby resulting in a more secure connection between the strap 38 and the frame member 14. Specifically, the stretching of the strap 38 causes the end 40 to pivot about the wire 28 and cause the end 40 to wedge between the frame member 14 and the wire 28. The wedging of the ends 40, 42 of the strap 38 between the wire 28 and the frame member 14 can be accomplished independent of whether the recessed portion 44 is present for that particular embodiment.

As explained above, the wire 28 may be located on the top, bottom, interior, or exterior sides 32, 34, 36, 37 of the member 14. Accordingly, the ends 40, 42 of the strap 38 must have a conforming geometry. For example, the first end 40 is configured to couple with the wire 18 coupled to the bottom side 36 of the frame member 14, and the second end 42 of the strap 38 is configured to couple with a wire 28 which is located on the top 32 of the member 14. Of course, the location of the recessed portion 44 of the strap 38 is also application dependent.

Although the present invention has been described with reference to preferred embodiments, those skilled in the art will recognize that changes may be made and formed in detail without departing from the spirit and scope of the invention. It is therefore intended that the foregoing detailed description be regarded as illustrative rather than limiting, and that it be understood that it is the following claims, including all equivalents, that are intended to define the scope of this invention.

What is claimed is

1. A body support assembly comprising:

a pair of spaced apart frame members defining an opening therebetween, at least one of the frame members comprising a plurality of loops spaced along the frame, each of the loops defining an aperture; and an elastomeric strap extending across the opening between the pair of spaced apart members, the elastomeric strap comprising a retention portion disposed through the aperture, wherein the retention portion comprises a groove with a shape complimentary to that of one of the loops, where a portion of the loop is seated within the groove of the retention portion.

2. The body support assembly of claim 1 wherein the plurality of loops are separate from at least one of the frame members.

3. The body support assembly of claim 1 wherein the plurality of loops are integral with at least one of the frame members.

4. The body support assembly of claim 1 wherein the plurality of loops are distinct from one another.

5. The body support assembly of claim 1 wherein the plurality of loops are formed from a continuous wire.

6. The body support assembly of claim 1 wherein the elastomeric strap comprises at least one aperture disposed therethrough.

7. The body support assembly of claim 6 wherein a cushion material encapsulates at least a portion of the elastomeric strap.

8. The body support assembly of claim 1 wherein a plurality of loops are spaced along both of the spaced apart frame members.

9. The body support assembly of claim 8 wherein a plurality of elastomeric straps extend across the opening between the pair of spaced apart frame members.

10. The body support assembly of claim 9 wherein a portion of at least one of the elastomeric straps is disposed through at least one of the apertures formed by the plurality of loops.

11. The body support assembly of claim 9 wherein the retention portion has a cross-sectional area greater than that of the cross-sectional area of the aperture.

12. The body support assembly of claim 1 wherein a cushion material encapsulates at least a portion of the elastomeric strap.

13. The body support assembly of claim 12 wherein the cushion material comprises a foam.

14. A body support assembly comprising:

a pair of spaced apart frame members defining an opening therebetween, at least one of the frame members comprising a plurality of loops spaced along the frame, each of the loops defining an aperture;

an elastomeric strap extending across the opening between the pair of spaced apart members, the elastomeric strap comprising a retention portion disposed through the aperture; and a cushion material encapsulating at least a portion of the elastomeric strap, and wherein a relief channel is formed within the cushion material.

15. The body support assembly of claim 14 wherein the relief channel is located at least partially along a centerline of the cushion material.

16. The body support assembly of claim 14 wherein the relief channel is located at least partially along a portion of the cushion material corresponding to the location of the t10/12 vertebra of a user.

17. The body support assembly of claim 14 wherein the relief channel further comprises a plurality of relief channels forming a relief zone.

18. The body support assembly of claim 17 wherein the elastomeric strap comprises at least one aperture disposed therethrough.

19. The body support assembly of claim 14 wherein the cushion material comprises a foam.

* * * * *